US006622495B2

(12) United States Patent
Nishii

(10) Patent No.: US 6,622,495 B2
(45) Date of Patent: Sep. 23, 2003

(54) EJECTOR AND REFRIGERATING MACHINE

(75) Inventor: Kenichiro Nishii, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/070,815

(22) PCT Filed: Jul. 11, 2001

(86) PCT No.: PCT/JP01/05997

§ 371 (c)(1),
(2), (4) Date: Mar. 11, 2002

(87) PCT Pub. No.: WO02/06740

PCT Pub. Date: Jan. 24, 2002

(65) Prior Publication Data

US 2002/0134103 A1 Sep. 26, 2002

(30) Foreign Application Priority Data

Jul. 13, 2000 (JP) ..... 2000-213252

(51) Int. Cl.[7] ..... F25B 1/06; F25B 43/02
(52) U.S. Cl. ..... 62/84; 62/500
(58) Field of Search ..... 62/84, 85, 169, 62/193, 469, 470, 500

(56) References Cited

U.S. PATENT DOCUMENTS

| | | | | |
|---|---|---|---|---|
| 5,606,872 A * | 3/1997 | Terasaki | ..... | 62/471 |
| 6,438,993 B2 * | 8/2002 | Takeuchi et al. | ..... | 62/500 |

FOREIGN PATENT DOCUMENTS

| | | | | |
|---|---|---|---|---|
| EP | 0531248 A1 * | 9/1992 | ..... | 62/470 |
| JP | 62-183824 | 8/1987 | | |
| JP | 7-083526 | 3/1995 | | |
| JP | 9-210510 | 8/1997 | | |
| JP | 11-201100 | 7/1999 | | |
| JP | 2000-009040 | 1/2000 | | |

* cited by examiner

*Primary Examiner*—Melvin Jones
(74) *Attorney, Agent, or Firm*—Oblon, Spivak, McClelland, Maier & Neustadt, P.C.

(57) ABSTRACT

An ejector that does not inhibit a flow of fluid and a refrigerating system provided with the ejector. The ejector includes a hollow passage, i.e. a negative pressure generating passage, through which fluid flows, a member having a hole disposed in the hollow passage, a negative pressure chamber disposed downstream of the member having a hole, and a hollow passage, i.e. an inlet passage, open to the negative pressure chamber. A filter, such as a mesh, is disposed in the inlet passage.

8 Claims, 3 Drawing Sheets

EJECTOR AND REFRIGERATING MACHINE

TECHNICAL FIELD

The present invention relates to an ejector which draws in fluid by generating a negative pressure, and a refrigerating system provided with such an ejector.

BACKGROUND ART

FIG. 3 is a schematic diagram showing the configuration of a refrigerating system provided with a conventional ejector. In this refrigerating system, the condenser 1 is connected to the evaporator 2 by refrigerant pipes 3 and 7, and the refrigerant pipe 7 is also connected to the compressor 5. The refrigerant in the refrigerant pipes 3 and 7 is circulated between the condenser 1 and the evaporator 2 by the compressor 5.

In such a conventional refrigerating system, a problem may arise when a piece of the wire mesh, which is disposed in the mist tank 8, breaks off and flows out toward the ejector 10 together with lubricating oil. The piece of wire mesh may become stuck in the ejector 10 and inhibit the circulating flow of the lubricating oil.

The present invention takes into consideration the above-mentioned circumstances, and has as an object to provide a refrigerating system and an ejector which does not interfere with the flow of fluid.

DISCLOSURE OF INVENTION

In accordance with one aspect of the invention, an ejector includes a negative pressure generating passage through which fluid flows; a member having a small hole disposed in the negative pressure generating passage, the fluid flowing through the small hole of the member; a negative pressure chamber disposed downstream of the member having a small hole; and an inlet passage opening to the negative pressure chamber, wherein a filter means is disposed in the inlet passage.

According to the above ejector, solid contaminants, such as pieces of wire mesh, contained in the fluid which flows into the negative pressure chamber via the inlet passage, may be removed by the filter means.

In accordance with another aspect of the invention, the filter means is a mesh type member.

According to the above ejector, solid contaminants may be removed when the fluid passes through the mesh type member.

In accordance with another aspect, the present invention provides a refrigerating system including a lubricating oil tank; an evaporator; an equalizing pipe member which connects the lubricating oil tank to the evaporator; a mist tank connected to the equalizing pipe member, the mist tank separating lubricating oil from a fluid which flows through the equalizing pipe member; and an ejector for removing the lubricating oil, which is separated in the mist tank, from the mist tank. The ejector includes a negative pressure generating passage through which a fluid flows; a member having a small hole disposed in the negative pressure generating passage, the fluid flowing through the small hole of the member; a negative pressure chamber disposed at a downstream side of the member having a small hole; and an inlet passage opens to the negative pressure chamber, the inlet passage being communicated with the mist tank. The ejector is the same as the one mentioned above.

In the above refrigerating system, the lubricating oil separated in the mist tank flows into the ejector. Although a lubricating oil separation means, such as a wire mesh, is provided in the mist tank in order to separate the lubricating oil, solid impurities, such as wire mesh pieces, may sometimes be included in the lubricating oil from the mist tank. Such solid impurities are removed by a filter means disposed in the ejector.

In yet another aspect of the invention, in the above refrigerating system, the fluid which flows through the negative pressure generating chamber comprises lubricating oil discharged from an outlet of an oil pump.

The oil pump may be disposed in the oil tank or outside the oil tank as long as it is disposed within the passages for supplying the lubricating oil in the oil tank to the portions of the compressor which require oil supply.

In yet another aspect of the invention, the refrigerating system further includes a non-return valve provided within the passage connecting the ejector to the negative pressure chamber, the non-return valve being capable of preventing flow from the negative pressure chamber toward the filter means.

According to the above refrigerating system, it becomes possible to block the flow from the negative pressure chamber side of the ejector toward the filter means, and it becomes possible to prevent the pieces of the wire mesh caught by the filter means from flowing backward.

BEST MODE FOR CARRYING OUT THE INVENTION

Figure 1:
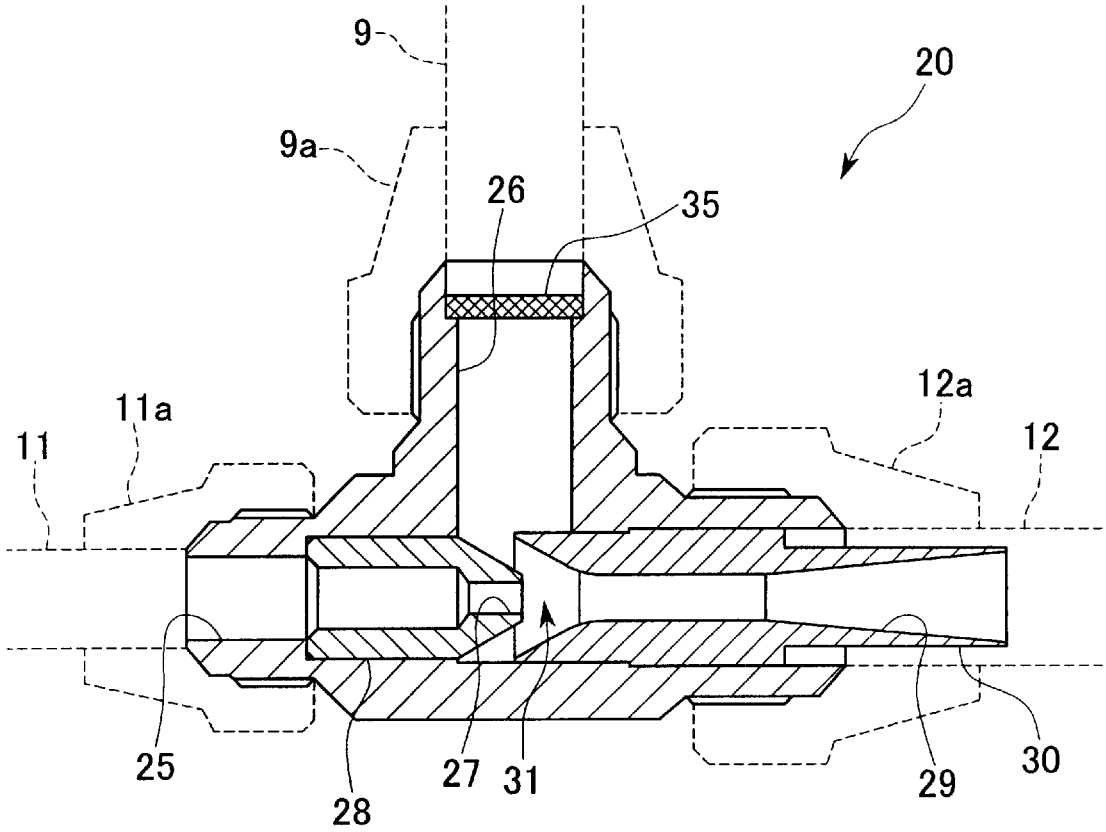
FIG. 1 is a diagram showing an ejector according to an embodiment of the present invention which may be used in a refrigerating system.

Next, embodiments of the present invention will be explained with reference to the accompanying drawings. Note that the same numerals are used for elements which are the same as the ones shown in FIG. 3, and the explanation thereof will be omitted.

The compressor 5 is provided with the oil tank 6 (i.e., a lubricating oil tank) which contains lubricating oil, and the oil tank 6 is connected to the evaporator 2 via an equalizing pipe 4 in order to make the pressure of the oil tank 6 the lowest in the refrigerating cycle. Although the refrigerant vapor and the lubricating oil as oil mist from the oil tank 6 flow through the equalizing pipe 4 since the pressure in the oil tank 6 is high, the equalizing pipe 4 is provided with the mist tank 8 in order to prevent the oil mist from flowing into the evaporator 2. A wire mesh (not shown in the figure) is disposed in the mist tank 8 so that oil mist, which is contained in a refrigerant vapor-oil mist mixture supplied from the oil tank 6 via the equalizing pipe 4, may be attached to the wire mesh and drip therefrom when the refrigerant vapor-oil mist mixture passes through the wire mesh.

The mist tank 8 is connected to an ejector 20 via a pipe 9 so that lubricating oil, which has been separated from the refrigerant vapor-oil mist mixture in the mist tank 8, can be discharged via the pipe 9. Also, the ejector 20 is connected to the main lubricant route of the refrigerating system via a pipe 11, and to the oil tank 6 via a pipe 12.

FIG. 1 is a diagram showing the ejector 20 according to an embodiment of the present invention. The ejector 20 may be used in the refrigerating system instead of the conventional ejector 10 shown in FIG. 3.

The ejector 20 according to an embodiment of the present invention is substantially T-shaped, and the pipe 11, which is connected to the lubricant route, and the pipe 12, which is connected to the oil tank 6, are connected to the ejector 20 so as to be aligned in a straight line. Also, the pipe 9, which connects the ejector 20 to the mist tank 8, is disposed so as to be perpendicular to the pipes 11 and 12.

A hollow passage (a negative pressure generating passage) 25, which is designed to be a straight line, and another hollow passage (an inlet passage) 26, which is designed so as to be substantially perpendicular to the hollow passage 25, are formed in the ejector 20. A hollow orifice member 28 having a small hole 27 at an end portion thereof, is engaged with a nozzle member 30 having a hollow portion 29, both ends of which are tapered so as to increase in size towards the ends thereof as shown in FIG. 1, and they are inserted and attached to the inner wall of the hollow passage 25. A negative pressure chamber 31, which is open to the hollow passage 26, is formed between the orifice member 28 and the nozzle member 30.

Also, a disc-shaped mesh (a filtering member, a net device) 35 is detachably disposed in the hollow passage 26.

The pipe 11 is connected to the outside of the orifice member 28 (i.e., the hollow passage 25) via a nut 11*a*, and the pipe 12 is connected to the outside of the nozzle member 30 via a nut 12*a*. Also, the pipe 9 is connected to the hollow passage 26 via a nut 9*a*.

Figure 2:
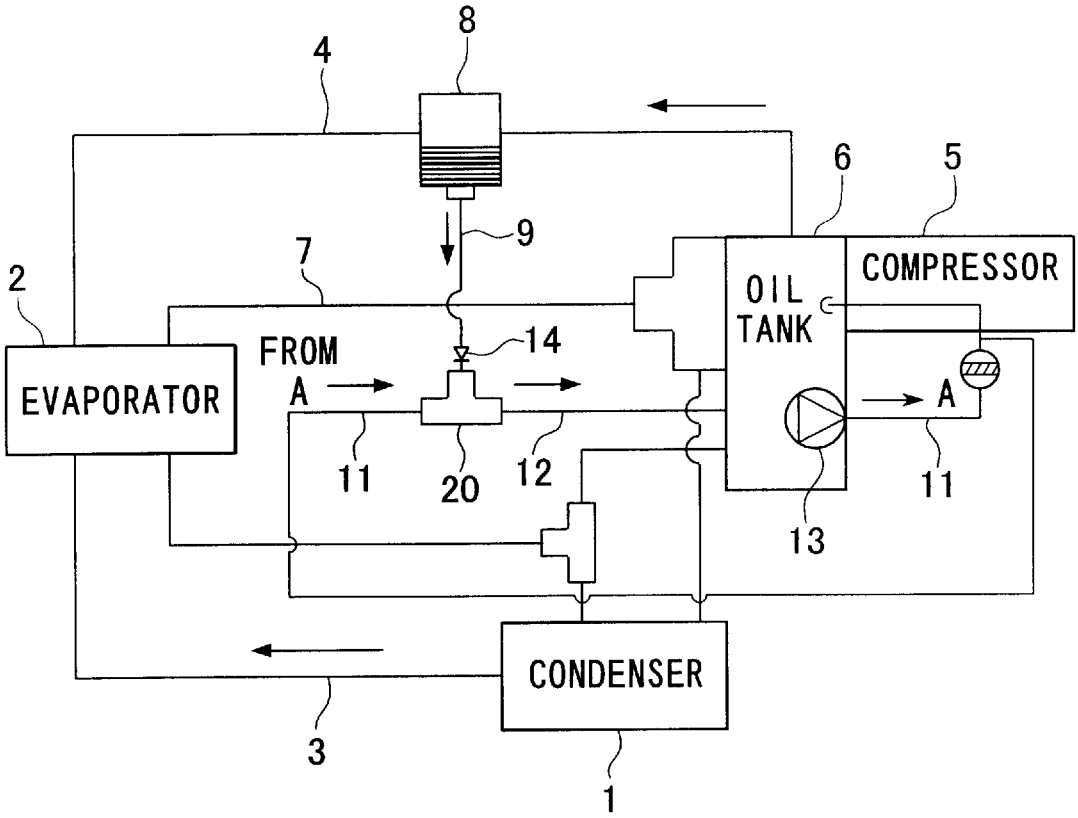
FIG. 2 is a schematic diagram showing the configuration of a refrigerating system according to an embodiment of the present invention using the ejector shown in FIG. 1.

The pipe 11 is arranged as shown in FIG. 2.

That is, the refrigerating system according to an embodiment of the present invention may be a turbo refrigerating system, and the main route of the lubricating oil is normally constructed so that the lubricating oil is supplied to the portions of the compressor 5, which require oil supply, from the oil tank 6 via the pipe 11 by means of an oil pump 13 disposed in the oil tank 6. The lubricating oil which has been used for lubricating the compressor 5 is returned to the oil tank 6 via the pipe 11. An oil cooler may be disposed along the route of the lubricating oil.

On the other hand, a part of the pipe 11 is branched from the above-mentioned main route of the lubricating oil and connected to the ejector 20 so that a portion of the lubricating oil is supplied to the ejector 20. The lubricating oil which is supplied to the ejector 20 is returned to the oil tank 6 via the pipe 12.

Accordingly, the fluid which flows through the negative pressure generating passage 25 of the ejector 20 is the lubricating oil supplied from the oil tank 6 by means of the oil pump 13.

Note that although the oil pump 13 is disposed in the oil tank 6 in this embodiment of the invention as shown in FIG. 2, the oil pump 13 may of course be disposed outside of the oil tank 6. That is, the oil pump 13 may be disposed anywhere as long as it is disposed along the passage for supplying the lubricating oil in the oil tank 6 to the portions of the compressor 5 which require oil supply.

In the refrigerating system having the above-mentioned configuration, the refrigerant in the refrigerant pipes 3 and 7 is circulated between the condenser 1 and the evaporator 2 by the actuation of the compressor 5. Accordingly, the refrigerant vapor-oil mist mixture from the oil tank 6 flows through the equalizing pipe 4, and the oil mist is separated from the mixture in the mist tank 8.

Also, as mentioned above, the lubricating oil flows into the ejector 20 via the pipe 11. The lubricating oil is injected to the nozzle member 30 via the small hole 27 of the orifice member 28. At that time, a negative pressure is generated in the negative pressure chamber 31, which is located between the orifice member 28 and the nozzle member 30, and the lubricating oil, which has been separated in the mist tank 8, is drawn into the ejector 20 and flows into the nozzle member 30 due to the negative pressure thus generated. The lubricating oil, which flows into the nozzle member 30, is returned to the oil tank 6 via the pipe 12.

As mentioned above, since a wire mesh is disposed in the mist tank 8, pieces of the wire mesh may break off and the broken off pieces thereof may flow into the ejector 20 together with the lubricating oil. However, because the filter means 35 is disposed in the hollow passage 26 of the ejector 20, the broken off pieces of the wire mesh are caught by the filter means 35 and do not reach the nozzle member 30. The pieces of the wire mesh caught by the filter means 35 in the manner mentioned above may be removed by periodically taking out and cleaning the mesh 35.

Also, according to another embodiment of the invention, a non-return valve 14 may be provided along the pipe 9 as shown in FIG. 2 to prevent flow from the ejector 20 to the mist tank 8.

In this manner, it becomes possible to prevent flow from the negative pressure chamber 31 toward the filter means 35, and therefore, to prevent the pieces of the wire mesh caught by the filter means 35 from flowing backward.

As explained above, since the mesh 35 is provided for the ejector 30 in the refrigerating system according to an embodiment of the present invention, it becomes possible to prevent the nozzle member 30 from being clogged by ruptured wire mesh pieces. Also, since the non-return valve 14 is provided along the pipe 9, it becomes possible to prevent the pieces of the wire mesh caught by the filter means 35 from flowing backward. Accordingly, it becomes possible to prevent the circulation of lubricating oil from being inhibited.

Figure 3:
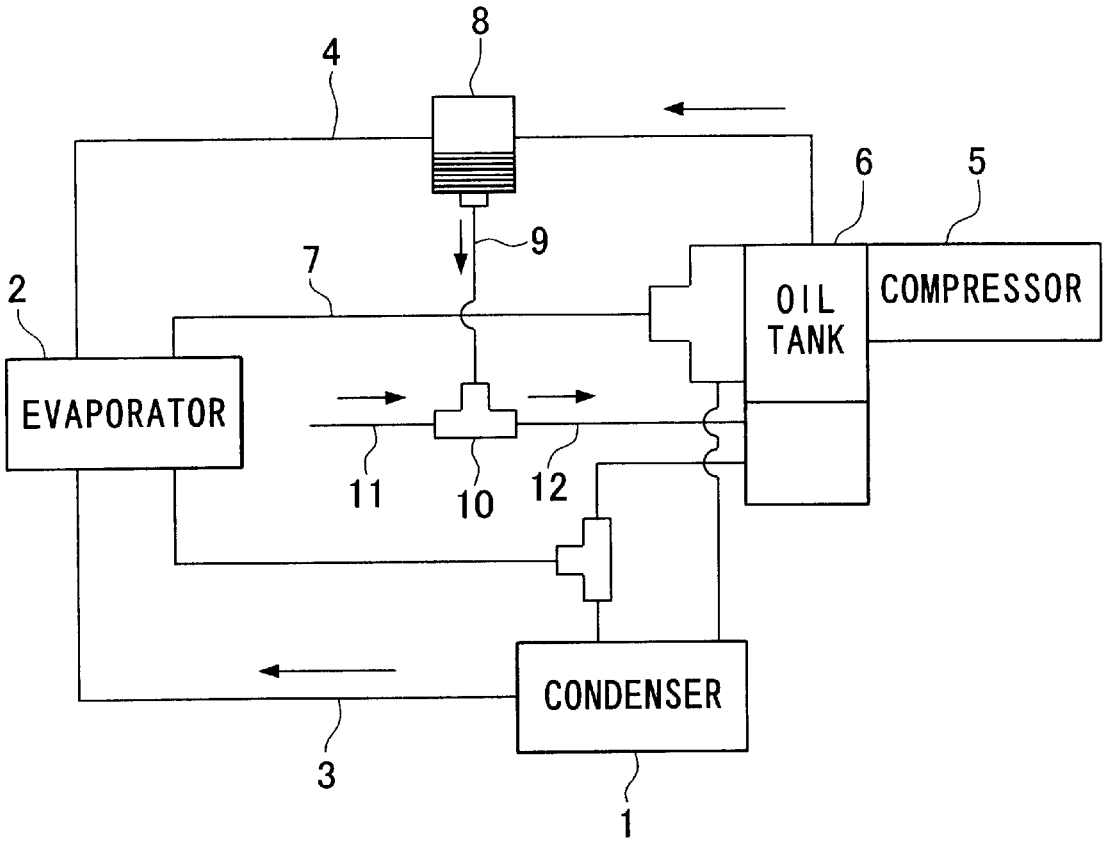
FIG. 3 is a schematic diagram showing the configuration of a conventional refrigerating system.

Also, since no pressure loss occurs as in the case where a strainer is used, the performance of the ejector 20 is excellent as compared with the case where a separate strainer is provided for the ejector 10 in a conventional refrigerating system (refer to FIG. 3)

Industrial Applicability

As explained above, according to the present invention, since a filter means is provided in the ejector, and a non-return valve is provided along the pipe, it becomes possible to prevent clogging of the ejector by wire mesh pieces, and it becomes possible to prevent the pieces of the wire mesh caught by the filter means from flowing backward. Accordingly, it becomes possible to prevent the circulation of lubricating oil from being inhibited.

What is claimed is:

1. A refrigerating system, comprising:

a lubricating oil tank;

an evaporator;

an equalizing pipe member connecting said lubricating oil tank to said evaporator;

a mist tank connected to said equalizing pipe member and which separates lubricating oil from a fluid which flows through said equalizing pipe member; and an ejector which removes the lubricating oil separated in said mist tank from said mist tank, the ejector including:

a negative pressure generating passage through which a fluid flows;

a member having a first hole disposed in said negative pressure generating passage, said fluid flowing through said first hole of said member;

a negative pressure chamber disposed at a downstream side of said member having a second hole;

an inlet passage open to said negative pressure chamber, said inlet passage communicating with said mist tank; and a filter deposed in said inlet passage.

2. A refrigerating system as set forth in claim 1, wherein said filter comprises a mesh member.

3. A refrigerating system as set forth in claim 1, wherein said fluid which flows through said negative pressure generating chamber comprises lubricating oil discharged from an outlet of an oil pump.

4. A refrigerating system as set forth in claim 2, wherein said fluid which flows through said negative pressure generating chamber comprises lubricating oil discharged from an outlet of an oil pump.

5. A refrigerating system as set forth in claim 3, further comprising:

a non-return valve provided along a passage connecting said ejector to said negative pressure chamber, said non-return valve configured to prevent a flow from said negative pressure chamber toward said filter.

6. A refrigerating system as set forth in claim 4, further comprising:

a non-return valve provided along a passage connecting said ejector to said negative pressure chamber, said non-return valve configured to prevent a flow from said negative pressure chamber toward said filter.

7. An ejector, comprising:

a negative pressure generating passage through which fluid flows;

a member having a first hole disposed in said negative pressure generating passage, said fluid flowing through said first hole of said member;

a negative pressure chamber disposed downstream of said member having a second hole; and an inlet passage open to said negative pressure chamber; and a filter disposed in said inlet passage.

8. An ejector as set forth in claim 7, wherein said filter comprises a mesh member.

* * * * *